US006150936A

United States Patent [19]

Addy

[11] Patent Number: 6,150,936

[45] Date of Patent: Nov. 21, 2000

[54] METHOD AND SYSTEM FOR ANALYZING RECEIVED SIGNAL STRENGTH

[75] Inventor: Kenneth L. Addy, Massapequa, N.Y.

[73] Assignee: Pittway Corporation, Chicago, Ill.

[21] Appl. No.: 09/141,232

[22] Filed: Aug. 27, 1998

Related U.S. Application Data

[63] Continuation-in-part of application No. 08/685,539, Jul. 24, 1996, Pat. No. 5,801,626, which is a continuation-in-part of application No. 08/650,292, May 20, 1996, Pat. No. 5,828, 300.

[51] Int. Cl.[7] ..... G08B 1/08

[52] U.S. Cl. ..... 340/539; 340/514; 340/506

[58] Field of Search ..... 340/539, 531, 340/514, 506, 515, 825.69, 825.72; 455/423, 32.1, 134, 513, 67.1

[56] References Cited

U.S. PATENT DOCUMENTS

| | | | |
|---|---|---|---|
| 4,101,872 | 7/1978 | Pappas | 340/539 |
| 4,191,948 | 3/1980 | Stockdale | 340/539 |
| 4,367,458 | 1/1983 | Hackett | 340/539 |
| 4,442,426 | 4/1984 | Heuschmann et al. | 340/539 |
| 4,523,184 | 6/1985 | Abel | 340/539 |
| 4,672,365 | 6/1987 | Gehman et al. | 340/539 |
| 4,754,261 | 6/1988 | Marino | 340/539 |
| 5,650,769 | 7/1997 | Campana, Jr. | 340/539 |

*Primary Examiner*—Donnie L. Crosland
*Attorney, Agent, or Firm*—Anthony R. Barkume, P.C.

[57] ABSTRACT

A self testing wireless data communications system suitable for use with an alarm system, the receiving element of the communications system is capable of measuring the signal strength (RSSI) of the received message and comparing it with stored signal information from a memory location associated with the ID of the transmitting device. Upon an unfavorable comparison, the system indicates a trouble condition by updating a user-interface visual display and/or alerting a central station. The system may have additional features such as the stored signal information may be updated to produce a running average of the RSSI of each message, or the indication of a trouble condition may include intelligent processing prior to updating a user-interface visual display. The system further comprises apparatus for initiating an install mode wherein a transmission from each of the remote devices causes RSSI data indicative of the signal strength of the received signal to be stored in the storage apparatus at a location associated with the ID of the remote device.

21 Claims, 4 Drawing Sheets

METHOD AND SYSTEM FOR ANALYZING RECEIVED SIGNAL STRENGTH

CROSS REFERENCE TO RELATED APPLICATIONS

This application is a continuation-in-part application of U.S. patent application Ser. No. 08/685,539, which was filed on Jul. 24, 1996 now U.S. Pat. No. 5,801,626 and which is incorporated by reference herein, which is a continuation-in-part application of Ser. No. 08/650,292, filed on May 20, 1996 now U.S. Pat. No. 5,828,300.

BACKGROUND OF THE INVENTION

The present invention relates to communications devices and protocols such as those used in wireless alarm systems having multiple sensors in communication with one or more receiver/controller units; and in particular to such alarm systems wherein the receiving unit of the system automatically provides an indication as to the signal strength of a received signal by measuring the signal strength of the signal and comparing it against a threshold.

Most radio frequency (RF) wireless security systems available today, such as those manufactured by ADEMCO, generally employ a multiplicity of transmitter products which transmit information to a common receiver/controller. The information transmitted typically describes the state of various transducers associated with each transmitter, such as smoke, motion, breaking glass, shock and vibration detectors; door, window and floor mat switches, etc. Each signal has a unique identification code embedded in its data message, which serves to identify to the system controller which particular transmitting device has sent that message.

Wireless security systems operating in residential and commercial buildings are often relied upon for Safety of Life applications. Many national regulatory agencies place stringent requirements on the operation of these types of systems, in the USA, Underwriter's Laboratories issues specifications, in the UK, British Standards apply, and in most of Europe, CENELEC harmonized norms set the specifications. In particular, it is becoming more common for these specifications to require that the received signal strengths from all sensor transmitters should be recorded at the time of installation such that at a later time of a periodic building inspection, an inspector can compare received signal strengths with those which were recorded at the time of original installation and relocate transmitters if necessary. In this set up, the inspector is relied upon for determining if there is a signal below margin. This may impose human error. Also in an environment where there are many changes, the inspector may not monitor the signal at a time when the signal is below margin.

In commercial buildings, particularly warehouses where material is continuously moved around, there may be sudden and significant changes in radio propagation due to a blocked signal path. Systems which are currently available, such as Ademco's 5800 system, determine this trouble condition by checking that each transmitter has sent a periodic check-in message to the receiver/controller. In these systems, if several check-in messages have not been received, then a supervision failure is indicated. Thus, the currently available systems will detect a transmitter's failure due to a changed environment or transmitter failure. However, these systems give no indication that a system's performance has been reduced and is in a marginal condition, i.e., the check-in messages still get through, but with poor margin. If an alarm condition should occur in this marginal state, then there is a risk that the message may not get through to the receiver/controller system.

It is therefore an object of the present invention to provide a communications system suitable for use with an alarm system which provides means for constantly measuring the signal strength of received messages (whether checkin or alarm) and automatically detecting a change in signal strength for each system transmitter.

It is a further object of the present invention to be able to measure and store signal information, such as the signal strength, of each transmitter during an install mode.

It is a further object of the present invention to provide a communications system suitable for use with an alarm system which provides an indication of a marginal condition at about the time that the signal margin is reduced.

SUMMARY OF THE INVENTION

In accordance with these and other objects, the present invention is a method for automatically testing a communications system, the communications system comprising a plurality of remote transmitting devices and a receiving station having a receiver associated therewith. The receiving station receives a signal from a transmitting device, generates Received Signal Strength Indication (RSSI) data indicative of the signal strength of the received signal, and determines the ID of the transmitting device. The receiver then retrieves stored signal information from a memory location associated with the ID, and compares the stored signal information with the RSSI data. When the comparison is unfavorable, a trouble condition is indicated.

In one embodiment, the stored signal information is tolerance compensated by subtracting a predetermined value from the stored signal information. In another embodiment, the stored signal information is compared to a processed RSSI data. The processed RSSI data may be a running average of the RSSI signal information and prior processed RSSI data stored in a memory location associated with the ID of the transmitting device.

The method further comprises an install mode wherein the stored signal information in memory is determined. The stored signal information is RSSI data indicative of the initial signal strength of the received signal from a transmitting device. The install mode is typically entered during system installation, but may also be used to update the stored signal information in memory when necessary, e.g., installation of new transmitter. When storing the signal information, the receiver receives the ID of the transmitting device from the installer, via keypad input, and stores the RSSI data in a location associated with the ID. The stored RSSI data may be an average of a number of RSSI data received during the install mode. If the stored signal information is not determined during installation, it may be programmed into memory at the factory during manufacturing, at the site by the installer or at the site by a download from a central station.

In one embodiment, indicating a trouble condition is simply updating a user-interface visual display. In a second embodiment, indicating a trouble condition comprises the steps of processing information stored in a memory location associated with the ID and updating a user-interface visual display. The processing of the information may include increasing the count stored in a memory location associated with the ID, checking if it is greater than a predetermined count and when it is greater, updating a user-interface visual display. In the second embodiment, the count stored in a memory location associated with the ID is reset when the tolerance compensated signal level is less than the RSSI signal information. In a third embodiment, indicating a trouble condition is the action of dialing up a central station. In this embodiment, a message is transmitted to the alarm system dialer by the processor/transmitter and the dialer transmits the trouble condition message to a central station. Additionally, dialing the central station may be delayed a short period of time to allow an on-site person to fix the trouble condition prior to alerting the central alarm station. In this case, alerting the central alarm station of the trouble condition may be considered a backup to other trouble indication methods.

The present invention is implemented by a system comprising a self-testing data communications system comprising a plurality of remote devices, each of the remote devices comprising means for transmitting signals, wherein the signals include an ID associated with the remote device, and a receiving station. The receiving station comprises means for receiving signals, means for generating an RSSI data indicative of the signal strength of the received signal, means for determining the remote device ID, storage means for signal information associated with the remote device ID, comparison means for comparing RSSI data to the stored signal information, processing means for determining the trouble condition set forth from above comparison, and indication means for indicating a trouble condition set forth from above comparison.

The system further comprises means for initiating an install mode wherein a number of transmissions from each of the remote devices causes an average of the RSSI data to be determined and stored in the storage means at a location associated with the ID of the remote device.

Lastly in the communications system, the remote devices communicate with the receiver by electromagnetic wave transmission which may be radio frequency.

DETAILED DESCRIPTION OF THE PREFERRED EMBODIMENT

Figure 1:
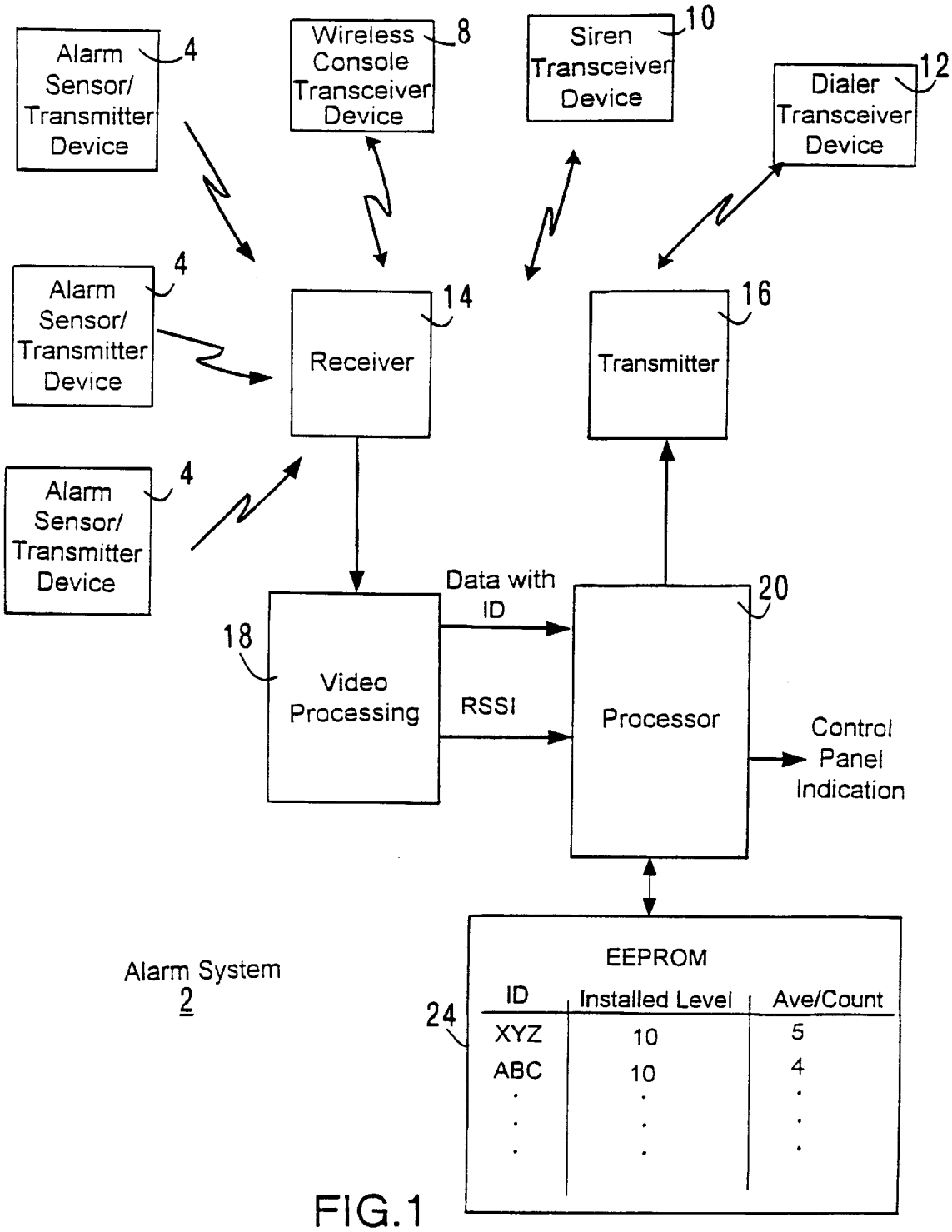
FIG. 1 is a block diagram of the preferred embodiment of the present invention.

Referring to FIG. 1, an alarm system 2 is shown. Included is a receiver 14 and a transmitter 16 in communication with a plurality of alarm sensor/transmitter devices 4, a wireless console transceiver device 8, a siren transceiver device 10, and a dialer transceiver device 12. The alarm sensors 4 include, for example, motion detectors, fire or smoke sensors, glass breakage sensors, door or window entry sensors, and the like. In the preferred embodiment, the alarm system 2 operates in a so-called wireless fashion by electromagnetic wave transmission (radio frequency in particular) between the devices 4, 8, 10, and 12 and the receiver 14 and transmitter 16. The alarm sensor/transmitter devices 4, wireless console transceiver device 8, siren transceiver device 10, and dialer transceiver device 12 are well known in the art and are not described in detail.

Further description of this type of wireless alarm system may be found in U.S. Pat. No. 4,754,261 to Marino, which is owned by the assignee of the present invention and is incorporated by reference herein.

A transmitting device transmits signals by modulating a high frequency RF signal (e.g., 345 MHz) which typically contains data, status, preamble, cyclic redundancy check data and the identification data (ID) of the transmitting device. The modulated RF signal is received by the receiver 14. The receiver 14 may comprise the following: an antenna selection circuit, an RF filter, a low noise amplifier, a second RF filter, a mixer, a local oscillator, an IF filter, an IF gain and demodulation circuit, and a video filter. Data formats and receiver circuits are all well known to one skilled in the art and are not described in further detail here.

The receiver 14 output is then processed by video processing 18, which provides two digital signals to the processor, data and a received signal strength indication (RSSI). The processor decodes the data signal and determines which action should be taken; e.g., if an alarm condition is indicated, then the transmitter 16 may transmit a command to the wireless console transceiver device 8, the siren transceiver device 10, and/or the dialer transceiver device. These actions are well known in the art and are not described here.

The present invention is based on the ability to monitor the power level of the received signal. This is done prior to processing the data signal. An RSSI measurement circuit, shown as video processing 18, measures the signal strength of the received signal and provides a digital output to the processor 20. RSSI measurement circuits are well known in the art, as set forth for example in U.S. Pat. Nos. 4,620,114; 5,390,365; and 5,423,064. The processor 20 inputs the RSSI data and compares it to a threshold located in a look-up table in EEPROM 24. If the comparison is unfavorable, a trouble condition is then indicated on the control panel, typically in the form of a visual display. It would be apparent to one skilled in the art that this may be any form of visual display or that the indication of trouble may be in the form of alerting a central station.

The look-up table in EEPROM 24 is programmed during installation with the identity of each device and an average of a number of RSSI data from the device at installation. The installer enters the install command at the wireless console 8. He then keys in the ID of a transmitter device (4, 8, 10 or 12) at the wireless console 8 and initiates the transmitter device (4, 8, 10 and 12) to send a number of messages to the receiver 14. The processor 20 determines the average of the RSSI data from the transmitter device (4, 8, 10 or 12) and stores it in a memory location associated with the ID. The installer will do this for each transmitter device (4, 8, 10 or 12). FIG. 1 shows a representation of the look-up table, wherein the ID has two memory locations associated with it. In this embodiment, one memory location contains the installed signal level described above, and the second memory location contains a value used to determine if a trouble condition should be indicated. This second location may contain historical data correlated to prior measured RSSI levels; for example, it may contain a running average of the RSSI of the data. A running average could be calculated, for example, by determining the average between the current RSSI value and the stored value, and storing that running average back into the memory. In this case, a trouble condition would be indicated if the running average went below a predetermined level (which may be the installed level plus or minus a tolerance function).

Once a trouble condition has been determined, the visual display may be updated as a direct result. Thus, the intelligent processing of this embodiment will allow the system to determine if a deleterious or fading condition truly exists, and then indicate the trouble condition to a user via the display.

In a second embodiment, the system will not indicate the deleterious or fading condition to the us er via the display until a trouble condition occurs for a predefined consecutive number of times. In this alternative, the second memory location may contain a count. In this case, the number of consecutive times that the RSSI data is below the installed level (within some tolerance) is counted. When this count exceeds a predetermined amount, than a trouble condition is indicated. The predetermined level for the average comparison, the predetermined amount for the count comparison, and the tolerance for the RSSI data comparison may be set during manufacture, onsite by the installer, or downloaded from the central station. These levels may be different for each transmitter, ie fire and smoke would need a more stringent test than a door opener would. It would be apparent to one skilled in the art that any number of memory locations may be associated with each ID and the memory locations may contain various information needed by different routines for processing of information necessary to monitor the power of the received signal.

Figure 2:
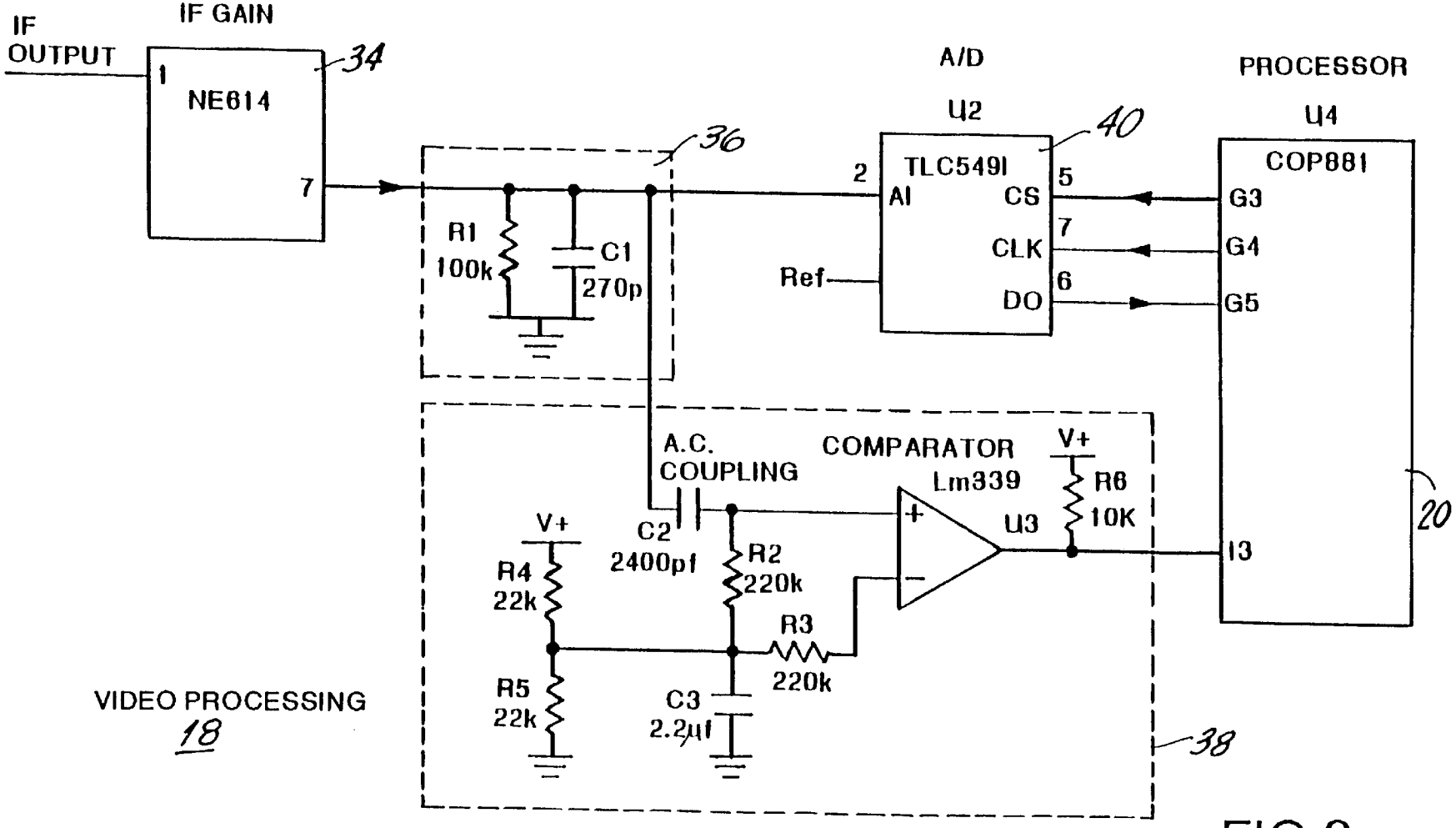
FIG. 2 is a detailed schematic of the video processing portion of the block diagram of FIG. 1.

FIG. 2 is a detailed circuit diagram of the video processing circuit 18 in FIG. 1. IF/demodulator integrated circuit 34, which in the preferred embodiment is a Philips NE614, utilizes the IF input signal and provides at its output a demodulated data signal to the low pass filter 36 formed by R1 and C1. The low pass filter 36 redu ces the noise content of the video output signal. The filtered video signal is then AC coupled via capacitor C2 to the non-inverting input of the U3 comparator (LM339), which quantizes the signal to a logic level suitable for input to the processor 20. The combination of R4 and R5 form a voltage divider, which sets a slicing level for the reference voltage applied to the inverting input to the U3 comparator. Capacitor C3 provides an AC ground for the U3 comparator reference input.

The output signal of comparator U3 is input to I3 of the processor 20. The processor in the preferred embodiment is a COP881 available from National Semiconductor. In particular, the output from U3 is fed to port I3 of the processor.

The filtered demodulated data signal is also input to an analog-to-digital (A/D) circuit 40, which provides a digital output representative of the input signal level (RSSI) in accordance with techniques well known in the art. In the preferred embodiment, a Texas Instruments TLC549I is used. A serial digital data word is then input to the port G5 of the processor 20 for storage in EEPROM 24 and subsequent analysis as described below.

Figure 3:
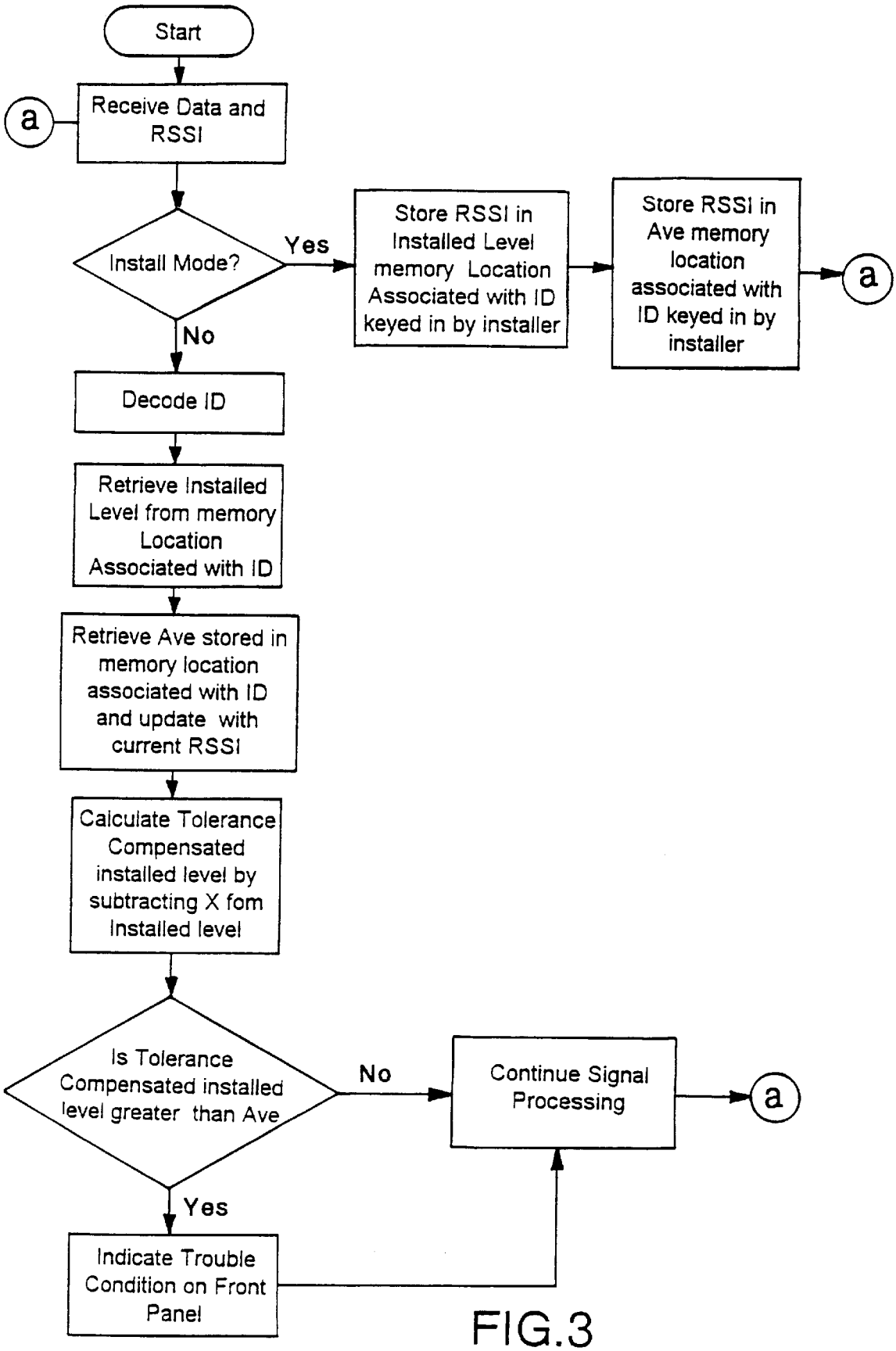
FIG. 3 is a flow chart of the operation of the preferred embodiment of the present invention.
Figure 4:
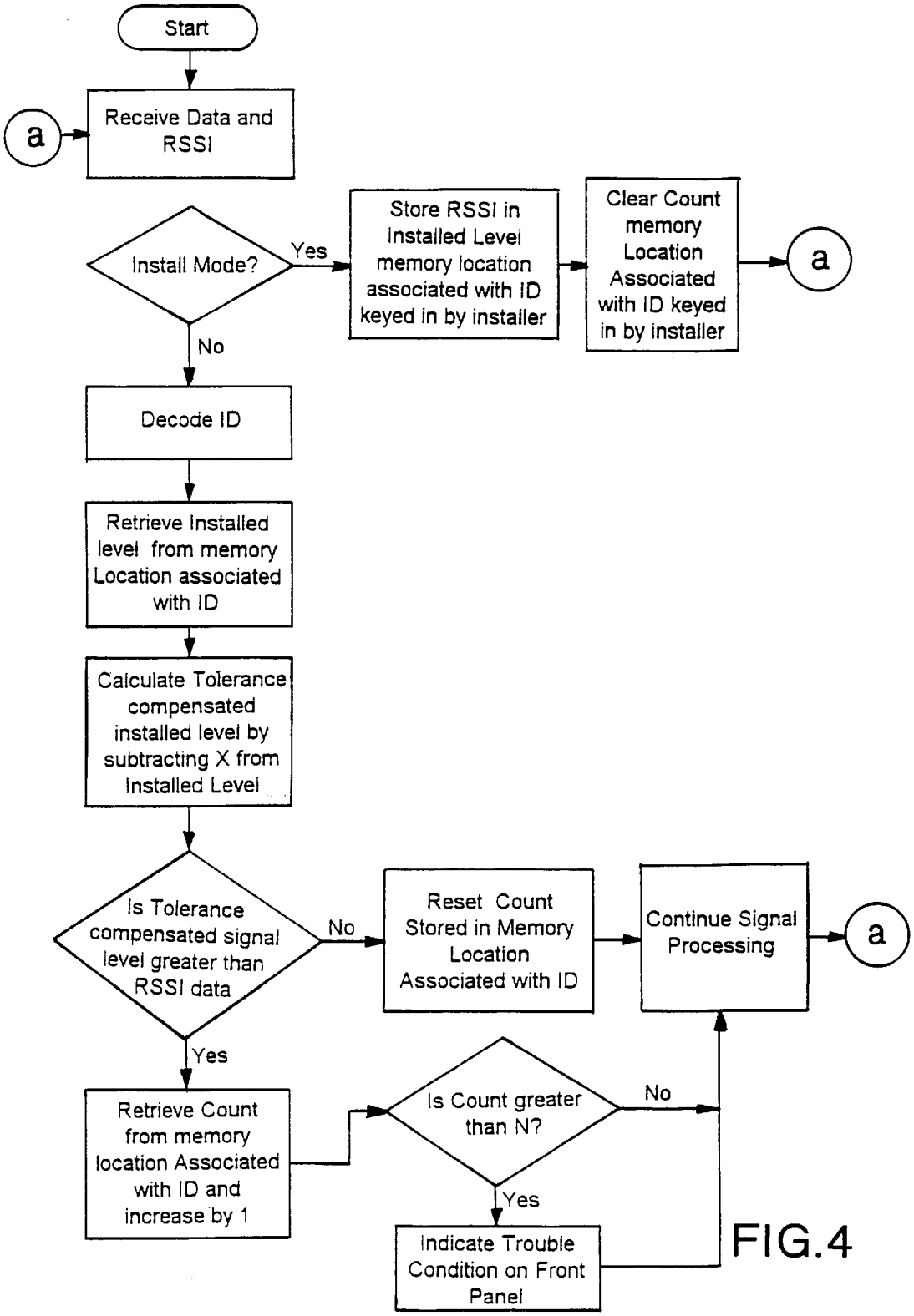
FIG. 4 is a flow chart of the operation of an alternative embodiment of the present invention.

Reference is now made to the flowcharts of FIG. 3 and FIG. 4. The flowchart of FIG. 3 is the first embodiment of the present invention, and FIG. 4 contains a second embodiment of the present invention. In the flow chart of FIG. 3, the received signal is processed by the aforementioned RF components, producing the data signal and the RSSI signal. The processor determines if the alarm system is in install mode. If the system is in install mode, then the RSSI data is stored in the installed level memory location and the Ave (Average) memory location in the EEPROM 24 at a location associated with the ID. If the alarm system is still in install mode when additional RSSI data is received, an average of the first RSSI data and the additional RSSI data is stored in both the installed level and Ave memory locations. If, however, it is determined that the alarm system is not in install mode, then the processor 20 decodes the ID bits of the data signal at I3 and retrieves installed level and Ave from memory locations associated with the ID. Ave is updated (by adding RSSI data and dividing by 2) with the current RSSI signal and a tolerance compensated level is calculated by subtracting a predetermined value X from the installed level. The tolerance compensated installed level is compared with Ave and if the tolerance compensated installed level is greater than Ave, a trouble condition is indicated on the front panel. In both instances, normal processing of the received signal takes place.

The value of X may be ascertained in various ways. In one embodiment, X may be preset at the factory by typical programming techniques. Alternatively, X may be programmed by the system installer, who may take measurements during initial operation of the system to determine the proper amount to use in accordance with the particular environment. Thirdly, the processor may be configured with techniques known in the art to make certain measurements of received signals, and determine an X to use accordingly. Lastly, the value of X maybe downloaded by the central alarm station.

Reference is now made to the flowchart of FIG. 4. This flow chart represents a second embodiment of the present invention. In the flowchart of FIG. 4, the received signal is processed by the aforementioned RF components, producing the data signal and the RSSI signal. The processor determines if the alarm system is in install mode. If the system is in install mode, then the RSSI data is stored in the installed level memory location in the EEPROM 24 at a location associated with the ID and the count memory location also associated with the ID is cleared. If the alarm system is still in install mode when additional RSSI data is received, an average of the first RSSI data and the additional RSSI data is stored in the installed level memory location. If however, it is determined that the alarm system is not in install mode, then the processor 20 decodes the ID bits of the data signal at I3 and retrieves the stored installed level from a memory location associated with the ID. The processor generates a tolerance compensated installed level by subtracting X from the installed level. The processor then compares the tolerance compensated installed level with the RSSI data. If the tolerance compensated installed level is not greater than the RSSI data, then the count stored in a memory location associated with the ID is reset, and normal processing of the signal continues. If however, the tolerance compensated installed level is greater than the current RSSI data, then the count stored in the memory location associated with the ID is increased by one. The count is then checked to see if it is greater than n (where n may equal 4, for example) and if it is, a trouble condition is indicated on the front panel. In both instances, normal processing of the received signal takes place.

As above, the value used for X may be ascertained in various ways. In one embodiment, X may be preset at the factory by typical programming techniques. Alternatively, X may be programmed by the system installer, who may take measurements during initial operation of the system to determine the proper amount to use in accordance with the particular environment. Thirdly, the processor may be configured with techniques known in the art to make certain measurements of received signals, and determine an average noise threshold to use accordingly. Lastly, the value of X maybe downloaded by the central alarm station.

Other ways to intelligently analyze the RSSI data that utilize historical RSSI data may also be utilized by the present invention.

Thus, while the particular embodiments of the present invention have been shown and described, various modifications will be apparent to those skilled in the art, and therefore it is not intended that the invention be limited to the disclosed embodiment or to details thereof and departures may be made therefrom within the spirit and scope of the present invention.

What is claimed is:

1. In a communications system comprising a plurality of remote transmitting devices and a receiving station having a receiver associated therewith, a method for automatically testing the communications system comprising the steps of:

a) receiving at said receiving station a received signal from a transmitting device;

b) generating RSSI data indicative of the signal strength of said received signal;

c) determining the ID of said transmitting device from said received signal;

d) retrieving from a first memory location associated with said ID stored signal information;

e) comparing said stored signal information with said RSSI data; and f) when said comparison is unfavorable, then indicating a trouble condition.

2. The method of claim 1 further comprising an install mode wherein said stored signal information is determined, using the steps of:

a) receiving at said receiving station a signal from a transmitting device;

b) generating RSSI data indicative of the signal strength of said received signal;

c) receiving at said receiving station the ID of said transmitting device from keycodes entered by an installer; and d) storing said RSSI data in said first memory location associated with said ID.

3. The method of claim 1 wherein a user-interface visual display is updated as a result of a trouble condition.

4. The method of claim 1 wherein the step of indicating a trouble condition comprises the step of storing information in a second memory location associated with said ID.

5. The method of claim 4 wherein the step of storing information further comprises the step of processing of the information in said second memory location associated with said ID.

6. The method of claim 4 further comprising the steps of:

a) retrieving said information from said second memory location associated with said ID;

b) comparing said information from said second memory location with a predetermined condition; and c) when said comparison is not favorable, updating a user-interface visual display.

7. The method of claim 6 wherein said information from said second memory location is a count.

8. The method of claim 7 further comprising the step of:

resetting said information in said second memory location when said comparison is favorable.

9. The method of claim 1 wherein a central station is dialed and sent a trouble message as a result of a trouble condition.

10. The method of claim 1 wherein said stored signal information is tolerance compensated prior to being compared to said RSSI data information.

11. The method of claim 10 wherein said stored signal information is tolerance compensated is generated by subtracting a predetermined value from said stored signal information.

12. The method of claim 1 wherein said RSSI data is a processed RSSI value correlated to historical RSSI data.

13. The method of claim 12 wherein said processed RSSI value is a running average of said current RSSI data and prior processed RSSI value stored in a second memory location associated with said ID.

14. The method of claim 2 wherein said RSSI data stored in said first memory location associated with said ID is an average of a number of RSSI data.

15. The method of claim 1 wherein said transmitting devices and said receiver communicate with electromagnetic wave transmission.

16. The method of claim 15 wherein said electromagnetic wave transmission is radio frequency wave transmission.

17. A self-testing data communications system comprising:

a) a plurality of remote devices, each of said remote devices comprising means for transmitting signals, wherein said signals include an ID associated with said remote device;

b) a receiving station comprising:

i) means for receiving signals;

ii) means for generating an RSSI data indicative of the signal strength of the received signal;

iii) means for determining said remote device ID;

iv) storage means for signal information associated with said remote device ID;

v) comparison means for comparing said RSSI data to said stored signal information;

vi) processing means for determining a trouble condition set forth from above comparison;

vii) indication means for indicating a trouble condition set forth from above comparison.

18. The system of claim 17 further comprising means for initiating an install mode wherein transmissions from each of said remote devices causes RSSI data indicative of the signal strength of the received signal to be stored in said storage means as said stored information.

19. The system of claim 17 wherein said remote device ID is correlated with said stored information.

20. The communications system of claim 17 wherein said remote devices and said receiving means communicate by electromagnetic wave transmission.

21. The communications system of claim 20 wherein said electromagnetic wave transmission is radio frequency wave transmission.

* * * * *